US010119745B1

(12) United States Patent
Gokhale et al.

(10) Patent No.: US 10,119,745 B1
(45) Date of Patent: Nov. 6, 2018

(54) AIR DEFLECTORS WITH FLEXIBLE HINGE FOR REFRIGERATED DISPLAY CASES

(71) Applicant: Heatcraft Refrigeration Products LLC, Richardson, TX (US)

(72) Inventors: Rahul Gokhale, Johns Creek, GA (US); Satish Kumar Jatashanker Singh, Chennai (IN); Ajay Chidambaram Pillai Swornalatha, Kanyakumari (IN); Santosh Ramakrishnan Nerur, Suwanee, GA (US)

(73) Assignee: Heatcraft Refrigeration Products LLC, Richardson, TX (US)

( * ) Notice: Subject to any disclaimer, the term of this patent is extended or adjusted under 35 U.S.C. 154(b) by 0 days.

(21) Appl. No.: 15/706,756

(22) Filed: Sep. 17, 2017

(51) Int. Cl.
*A47F 3/04* (2006.01)
*F25D 17/04* (2006.01)

(52) U.S. Cl.
CPC ..... *F25D 17/045* (2013.01); *A47F 3/0443* (2013.01); *F25D 2317/063* (2013.01)

(58) Field of Classification Search
CPC ..... A47F 3/04; A47F 3/0439; A47F 3/0443; A47F 3/0447; F25D 17/045
USPC ..... 312/116, 401; 62/256; 454/193
See application file for complete search history.

(56) References Cited

U.S. PATENT DOCUMENTS

| | | | | | |
|---|---|---|---|---|---|
| 3,727,537 | A * | 4/1973 | Harty, Jr. | B60H 1/00364 | 454/230 |
| 5,282,367 | A * | 2/1994 | Moore | A47F 3/0443 | 454/193 |
| 5,357,767 | A * | 10/1994 | Roberts | A47F 3/0447 | 454/193 |
| 7,696,434 | B2 * | 4/2010 | Ruddick | H02G 3/0418 | 138/108 |
| 7,797,959 | B2 * | 9/2010 | Amari | A47F 3/0447 | 62/256 |
| 8,713,954 | B2 * | 5/2014 | Stephens | A47F 3/0447 | 62/256 |
| 2014/0302766 | A1 * | 10/2014 | Sahu | A47F 3/0469 | 454/284 |

* cited by examiner

*Primary Examiner* — James O Hansen
(74) *Attorney, Agent, or Firm* — Hubbard Johnston, PLLC

(57) ABSTRACT

A refrigerated display case includes an air director that directs air with less turbulence in a resultant air curtain but also allows for the convenient removal of an air filter member by using a flexible hinge on a portion of the air deflector. Other embodiments are disclosed as well.

20 Claims, 4 Drawing Sheets

AIR DEFLECTORS WITH FLEXIBLE HINGE FOR REFRIGERATED DISPLAY CASES

TECHNICAL FIELD

This application is directed, in general, to refrigerated display cases, and more specifically, to air deflectors with a flexible hinge for refrigerated display cases.

BACKGROUND

Grocery stores and other purveyors of perishable goods often use refrigerator display cases to refrigerate and display the goods. Typically, the refrigerator display cases are vertical units with open fronts that allow consumers to view the goods and to reach into the case to retrieve the goods. Such systems typically have evaporator coils at a lower portion, and air is forced over the evaporator coils to create a cooled airstream. The cooled airstream is forced along an interior wall with some of the cooled airstream being distributed at various levels and portion reaching the top from where it is directed down a front portion of the display case to create a curtain of cool air. While these systems work well, improvements are still desired.

SUMMARY

According to an illustrative, non-limiting embodiment, a refrigeration display case for refrigerating and displaying perishable goods includes a base member for placing proximate a support surface; a back wall coupled to and substantially perpendicular to the base member and extending substantially vertically in an assembled position; and a canopy assembly coupled to and substantially perpendicular to the back wall. The canopy assembly has a front end, a short-dimension width, and a long-dimension length. The refrigeration display case also includes an air deflector coupled to the canopy assembly proximate the front end. The base member, back wall, and canopy assembly form a display area.

The air deflector directs air in a more desirable way with less turbulence in a resultant air curtain down the front of the refrigerated display case, but also allows for the convenient removal of an air filter member by using a flexible hinge on a portion of the air deflector. The air deflector includes a first member that is substantially vertical in an assembled position having a first end and a second end and having a first surface and an opposing second surface; a locating feature extending from the second surface of the first member; and a deflecting surface member extending from the second surface of the first member and having a distal end with a securing flange for securing to a portion of the canopy assembly. The deflecting surface member partitions the first member and defines a first portion and a second portion of the first member.

The second portion of the first member has a distal end that includes a first filter-support shelf member sized and is configured to receive a first end of a filter member. The air deflector includes a flexible hinge formed on the second portion of the first member to allow at least movement of a moveable portion of the second portion. The refrigeration display case further includes a second filter-support shelf member coupled to a portion of the canopy assembly and spaced from the first filter-support shelf member. The second filter-support shelf member is sized and configured to receive a second end of a filter member.

According to another illustrative, non-limiting embodiment, an air deflector for use in a refrigerated display case includes a first member that is substantially vertical in an assembled position having a first end and a second end and having a first surface and an opposing second surface; a locating feature extending from the second surface of the first member. The air deflector further includes a deflecting surface member coupled to and extending from the second surface of the first member and having a distal end with a securing flange for securing to a portion of the canopy assembly. The deflecting surface member partitions the first member and defines a first portion and a second portion of the first member. The second portion of the first member has a distal end that includes a first filter-support shelf member sized and configured to receive a first end of a filter member, and a flexible hinge is formed on the second portion of the first member to allow at least movement of a moveable portion of the second portion.

Other illustrative embodiments are presented below.

DESCRIPTION OF THE DRAWINGS

Illustrative embodiments of the present disclosure are described in detail below with reference to the attached drawing figures, which are incorporated by reference herein and wherein.

DETAILED DESCRIPTION

Figure 1:
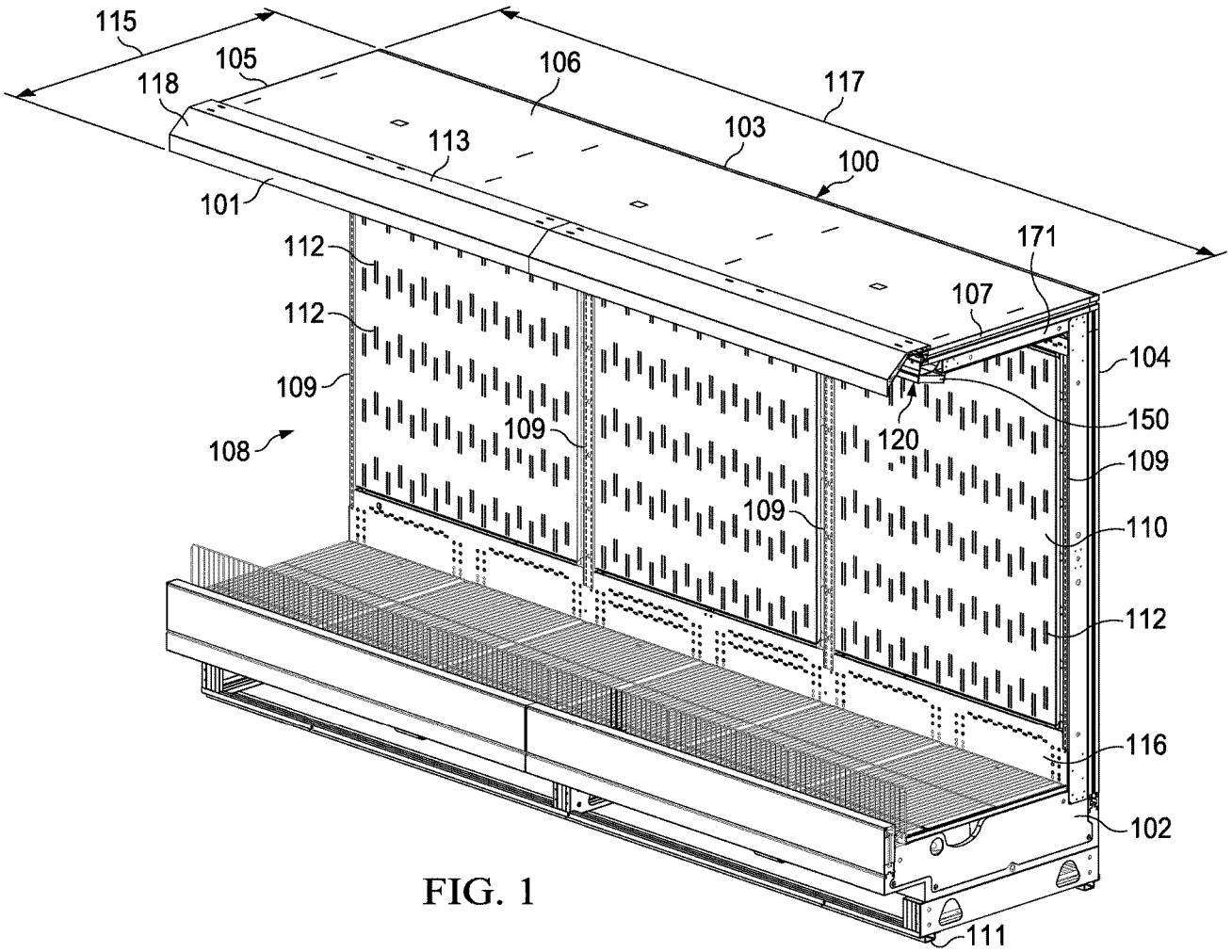
FIG. 1 is a schematic plan view of a refrigeration display case according to an illustrative embodiment of the present disclosure.

Referring to the figures, and initially and primarily to FIG. 1, a refrigeration display case 100 for refrigerating and displaying perishable goods primarily on shelves (not shown) is presented. The refrigeration display case 100 includes a base member 102 and a back wall 104 coupled to the base member 102. The back wall 104 is coupled to and substantially perpendicular to the base member and the back wall 104 extends substantially vertically (or substantially parallel to the local gravity field) in an assembled position.

The refrigeration display case 100 has a front 101, a back 103, a first side 105, and a second side 107. The refrigeration display case 100 has a top member, or canopy assembly 106, coupled substantially perpendicular (e.g., 80 to 100 degrees and typically 90 degrees) to the back wall 104. The base member 102, back wall 104, and top member 106 form an interior display area 108 in which the perishable goods are displayed. A front portion is open to the interior display area 108 and allows a consumer to reach in to obtain perishable goods in the interior display area 108. The base member 102 is against a support surface at 111, e.g., floor, and may include a trough having the compressor, evaporator, and other components for a refrigeration cycle.

The canopy assembly 106 is coupled to and substantially perpendicular to the back wall 104. The canopy assembly 106 has a front end 113, a short-dimension width 115, and a long-dimension length 117.

The back wall 104 may include a baffle panel 110 formed with a plurality of baffle apertures 112 to allow the cooled air to exit a portion of the back wall 104 at various locations of the interior display area 108. A plurality of shelves (not shown) may be coupled to the back wall 104 by vertical supports 109. The plurality of shelves is for supporting perishable goods to be displayed. A rack member 116 may be attached to a lower portion of the back wall 104 or to the base member 102.

As previously noted, the canopy assembly 106 may be coupled substantially perpendicularly to the back wall 104. The canopy assembly 106 may include light rail 118 for supplying light into the display area. The canopy assembly 106 may be coupled in part to a side support member 171. An air deflector 120 may be proximate the light rail 118 to direct a curtain of air downward (for orientation shown) through a filter member 150 and toward the base member 102 where it may be cooled and re-circulated. The cooled airflow is directed along the back wall 104 with portions being distributed through the baffle apertures 112 to various locations within the interior display area 108 and a portion being directed from the back wall 104 along an interior portion of the top member or canopy assembly 106 and with the help of the air deflector 120 down the front portion of the interior display area 108 to the base member 102.

Figure 2:
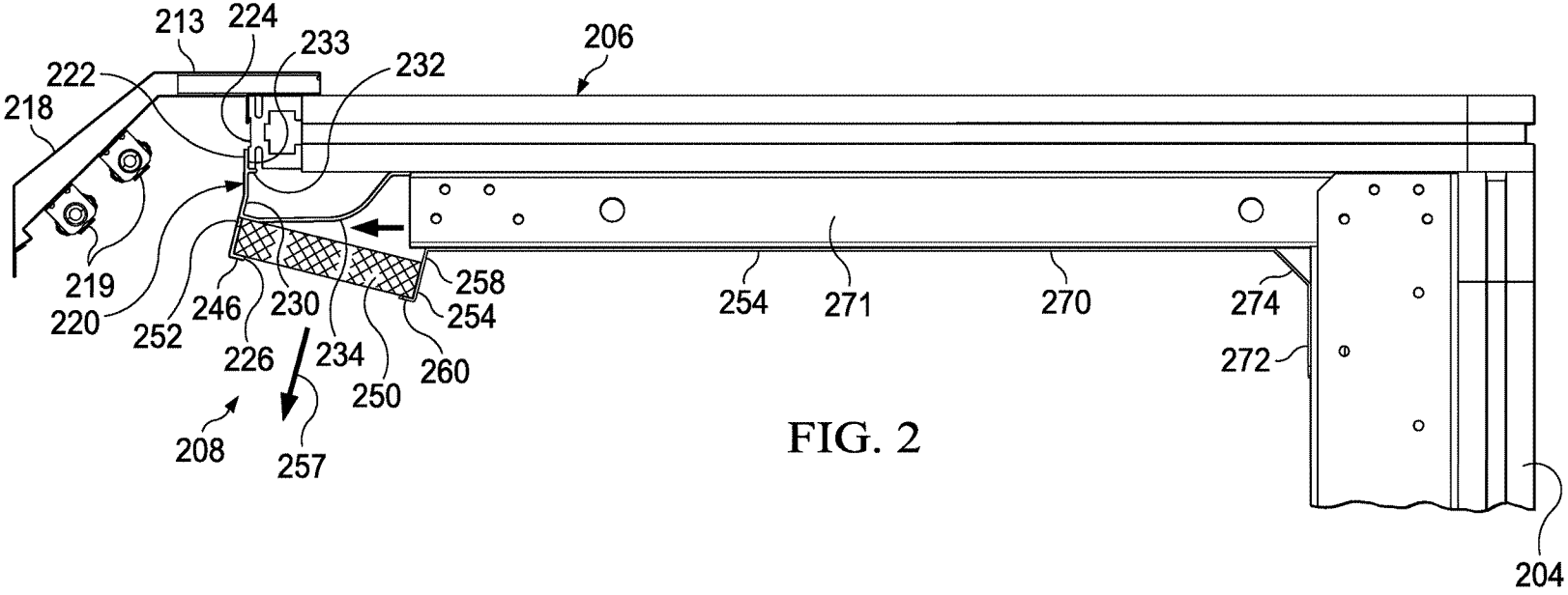
FIG. 2 is a schematic elevation view of a canopy portion of a refrigeration display case showing an air deflector according to an illustrative embodiment of the present disclosure.
Figure 3:
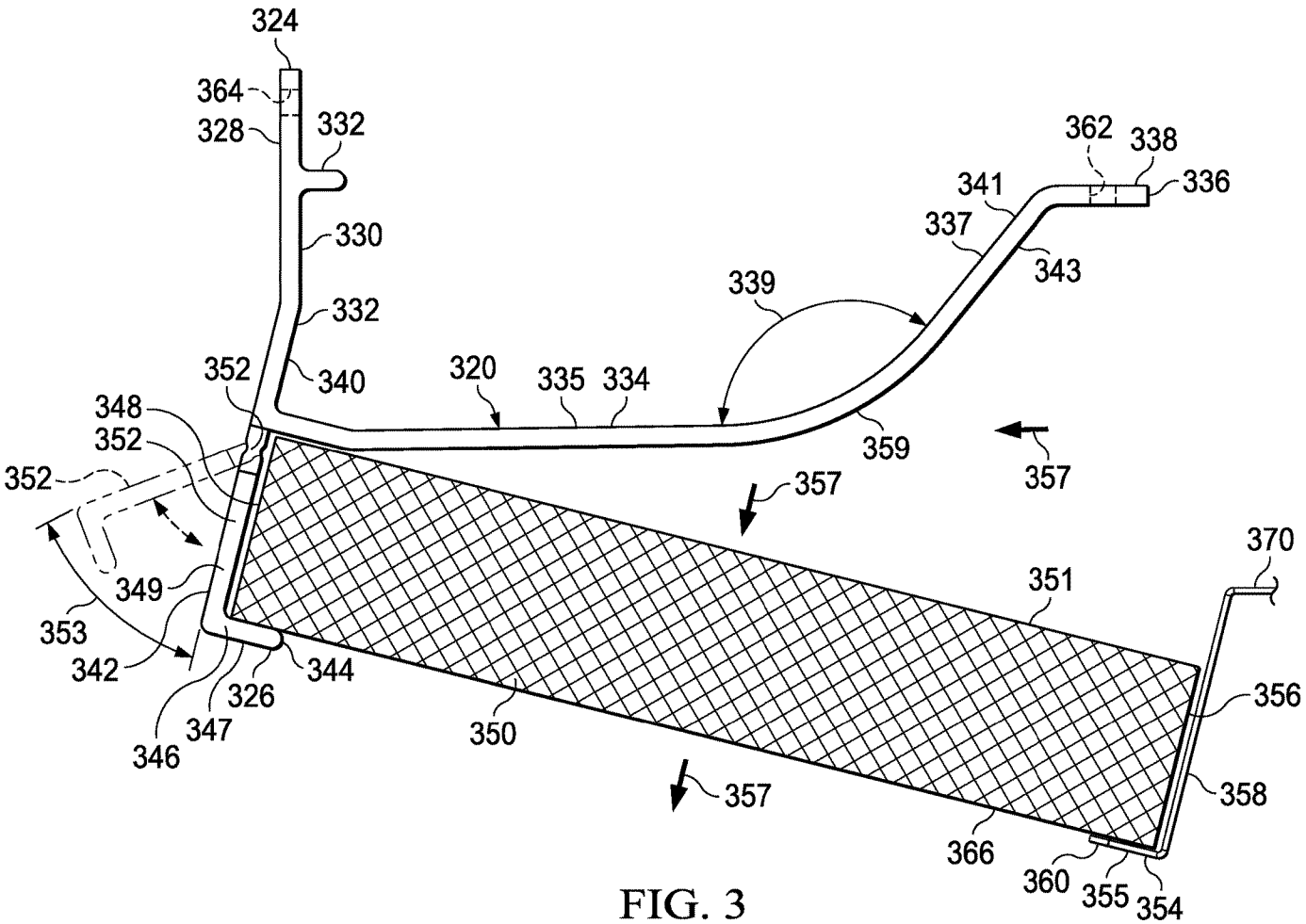
FIG. 3 is a schematic detail of an air deflector according to an illustrative embodiment of the present disclosure.

Referring now primarily to FIG. 2, an air deflector 220 is coupled to a canopy assembly 206 proximate a front end 213 thereof. In the side view, a light rail 218 is shown with two lights 219 and forming an end portion of the canopy assembly 206. The conditioned air 257 is delivered up a back wall 204 and then parallel the support member 271 before impacting the air deflector 220. The air deflector 220 causes the air 257 to change direction and impinge upon an air filter member 250 before being delivered as a curtain of air to a display area 208. The air deflector 220 may be smooth and provide for a smooth air flow through the filter member 250 and down the front of the refrigerated display case. The filter member 250 may be made from any suitable filtering material and may take many different sizes and shapes. In one illustrative embodiment, the filter member 250 has a rectangular cross section as shown in FIGS. 2 and 3.

The air deflector 220 extends along the length (see 117 in FIG. 1) of the refrigerated display case (see 100 in FIG. 1). The air deflector 220 includes a flexible hinge 252 that at a minimum allows sufficient movement of a portion of the air deflector 220 so as to allow the filter member 250 to be removed without requiring the removal of any fasteners. The flexible hinge 252 may be a living hinge formed by injection molding, extruded/co-extruded, or produced by stamping or machining to reduce or compress material.

Continuing to reference FIG. 2, the air deflector 220 includes a first member 222 that is substantially vertical (e.g., within 20 degrees of the gravitation field) in an assembled position as shown. The air deflector 220 has a first end 224 and a second end 226. The air deflector 220 also includes a locating feature 232 coupled to and extending from a surface 230 of the first member 222. The locating feature 232 may nestle under a tab member 233 on part of the canopy assembly 206. The tab member 233 may be part of a PVC stopper or other component that facilitates attachment. The air deflector 220 also has a deflecting surface member 234 coupled to and extending from the surface 230 of the first member 222.

The air deflector 220 includes a first filter-support shelf member 246 sized and configured to receive a portion of a filter member 250. The air deflector 220 is used in conjunction with or includes a second filter-support shelf member 254 coupled to a portion of the canopy assembly 206 and spaced from the first filter-support shelf member 246. The second filter-support shelf member 254 is sized and configured to receive a second portion of the filter member 250. The second filter-support shelf member 254 has a first member 258 or side support member that parallels an end of the filter member 250 and a second member 250 or shelf tab portion that is substantially perpendicular to the first member 358 and coupled thereto. The second filter-support shelf member 254 further includes a canopy surface portion 270 that extends substantially parallel to the side support member or surface 271 for coupling to the canopy assembly 206. The second filter-support shelf member may include an end portion 272 that is substantially perpendicular to the canopy surface portion 270. The canopy surface portion or member 270 may be coupled in some embodiments by angled portion 274 to the end portion 272.

Figure 4:
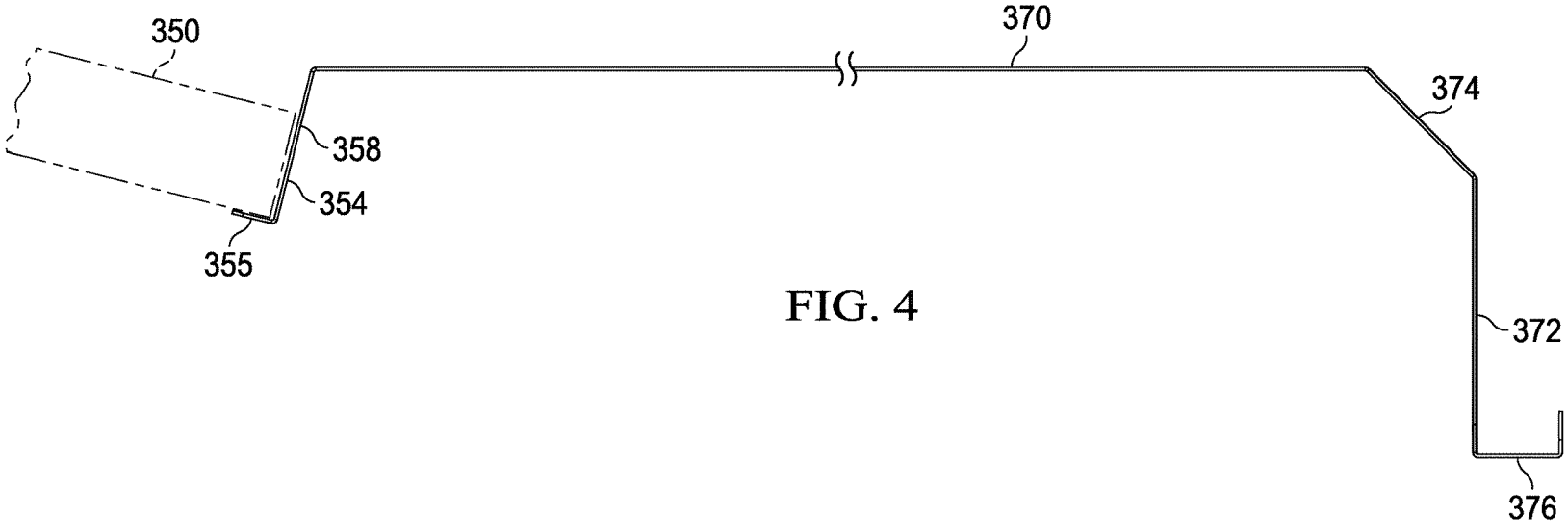
FIG. 4 is a schematic elevation view of a second filter-support shelf member according to an illustrative embodiment of the present disclosure.

Referring now primarily to FIGS. 3 and 4, an air deflector 320 is presented that is analogous in most respect to air deflectors 120 and 220. The air deflector 320 includes a first member 322 that is substantially vertical (e.g., within 20 degrees of being parallel to the gravitation field) in an assembled position. The first member 322 has a first end 324 and a second end 326 and has a first surface 328 and an opposing second surface 330. The air deflector 320 also includes a locating feature 332 coupled to and extending from the second surface 330 of the first member 322. The locating feature 332 is sized and configured to nestle under a tab member (e.g., tab member 233 in FIG. 2) as part of the assembly process. The first member 322 has a length, $L_1$, between the ends 324 and 326, and the locating feature 332 extends from the second surface between 5 percent and 45 percent of $L_1$ from the first end 324 of the first member 322. In one illustrative, non-limiting embodiment, the locating feature 332 has a length of between 5 and 20% of $L_1$.

The air deflector 320 includes a deflecting surface member 334 that is coupled to and extends from the second surface 330 of the first member 322 and has a distal end 336 with a securing flange 338 for securing to a portion of the canopy assembly (see, e.g., 106 in FIG. 1 and 206 in FIG. 2). The securing flange 338 may have a first fastener aperture 362 therethrough for receiving a fastener. The deflecting surface member 334 partitions the first member 322 and thereby defines a first portion 340 and a second portion 342 of the first member 322. The second portion 342 of the first member 322 has a distal end 344 that includes a first filter-support shelf member 346 sized and configured to receive a first end 348 of a filter member 350. The first filter-support shelf member 346 has a shelf portion 347 that is substantially perpendicular to a main portion 349 of the second portion 342.

When in the assembled position and with filter member 350 in place as shown in FIG. 3, the shelf portion 347 is under a portion of a bottom side 366 of a filter member 350 at a first end 348 and the face of the first end 348 of the filter member 350 is against main portion 349. In one illustrative, non-limiting embodiment, the first member 322 has a length, $L_1$, from end 324 to end 326 and wherein the deflecting surface member 334 is coupled to the first member 322 between 10 percent and 90 percent of the length, $L_1$, of the first member 322 from the first end 324. In another embodiment, the deflecting surface member 334 is coupled to the first member 322 between 50 percent and 90 percent of the length, $L_1$, of the first member 322.

In one illustrative, non-limiting embodiment, the deflecting surface member 334 has a total length $L_2$ from end to end, and the deflecting surface member 334 extends from the first member 322 substantially perpendicularly for between 40 percent and 60 percent of $L_2$ before curving upwardly (e.g., more parallel to the gravity field; in one embodiment between 35 and 55 degrees to the gravity field) and then ending with the securing flange 338 which is substantially horizontal and flat. The deflecting surface member 334 may have a first portion 335 and a second portion 337 with a curvature angle 339 formed therebetween. The curvature angle 339 is typically between 100 and 170 degrees. The deflecting surface member 334 thus presents a convex surface 359 for at least a portion of the air 357 to impinge upon and to be deflected thereby.

The air deflector 320 includes a flexible hinge 352 formed on the second portion 342 of the first member 322 to allow at least movement of a moveable portion 352 of the second portion 342. The moveable portion is between the flexible hinge 352 and the distal end 326. The flexible hinge 352 is configured to allow movement of the moveable portion 352 of the second portion 342. In one illustrative, non-limiting embodiment, the movement is between 5 and 40 degrees relative to the first portion 340 of the first member 322 as suggested by angle 353. The flexible hinge 352 may be a living hinge. The first member 322 may be an integrated member formed by injection molding or extrusion and then stamping or machining may be used to reduce or compress material in a portion to form the flexible hinge 352. If a living hinge, it may be injection molded, extruded/co-extruded, or produced by stamping or machining to reduce or compress material.

The air deflector 320 may include or be used in conjunction with a second filter-support shelf member 354 coupled to a portion of the canopy assembly 106 and spaced from the first filter-support shelf member 346. The second filter-support shelf member 354 is sized and configured to receive a second end 356 of a filter member 350. As shown in FIG. 3, the filter member 350 is held between the first filter-support shelf member 346 and the second filter-support shelf member 354.

As shown best in FIG. 4, the second filter-support shelf member 354 includes a second filter-support shelf member 354 having a shelf-tab portion 355 for interfacing with one side (e.g., bottom side 366) of the filter member 350 and a side support surface member 358, or filter abutment member, that extends substantially perpendicularly to the shelf-tab portion 355 for interfacing with a side 356 of the filter member 350. The second filter-support shelf member 354 includes a canopy surface portion 370 that extends substantially parallel to the side support surface 271 (FIG. 2) for coupling to the canopy assembly 206. The second filter-support member 354 includes an end portion 372 that is substantially perpendicular to the canopy surface portion 370. The canopy surface portion 370 may be coupled to the end portion 372 by and angled portion 374. A terminus portion 376, which may L shaped with a curl at the end, may be coupled to the end portion 372 to facilitate further attachment to the canopy assembly 206. One or more fasteners may be applied through a portion of the second filter-support member 354 to attach it to the canopy assembly 206.

Referring again primarily to FIG. 3, the air deflector 320 is attached to the canopy assembly 206 (FIG. 2) in this non-limiting embodiment by nestling the locating feature 332 underneath the tab member 233 and securing the first portion 322 to the canopy assembly 206 with a fastener, which may, for example, be placed through a fastener aperture 364 and through the tab member 233. Also, the second filter-support shelf member 354 is attached to the canopy assembly 206 such as with fasteners along canopy surface portion 370 or with end portion 372 and terminus portion 376. Again, the second filter-support shelf member 354 is displaced at a proper distance such that the filter member 350 fits with minimal clearance (e.g., 1% of width of filter or less) between the first filter-support shelf member 346 and the second filter-support shelf member 354 to securely, but removeably, hold the filter member 350 in place. When it is desired to replace the filter member 350, no fasteners need be removed with this embodiment. The person replacing the filter member 350 rotates the moveable portion 352 outward about the flexible hinge 352 as suggested by broken lines in FIG. 3 and the angle 353 such that the filter member 350 may be removed and a new filter member 350 insert. The moveable portion 352 is then released and allowed to return to the assembled, filter-hold position as shown in FIG. 3.

In some instances, it is recommended that the filter member be changed every three to four months. This can be time consuming and difficult with older systems require removal of screws up high on a refrigerated display case. The designs herein allow for quick removal of the filter member without requiring removal of screws or other fasteners.

In addition to facilitating easy replacement of filtering members, the deflector 320 also provides a smoother (than previous designs) air flow through the filter member 350. In this regard, the deflector surface member 334 has a first side 341 and a second side 343, and in the assembled positioned, the deflector surface member 334 is configured to have air 357 delivered from the back wall 104 (FIG. 1) impact the second side 343 and be directed to a top surface 351 of the filter member 350. The smoothened form of the air deflector 320 and particularly the deflector surface member 334 facilitates the smoother airflow.

The air deflectors presented herein are formed with smooth curves and turns and no abrupt corners. Consequently, the air deflector may produce more laminar flow that smoothens out the air and makes for a better flow—air curtain—down the front of the refrigerated display case. The air deflector may make for a slower variation in velocity profile at the filter member and that may reduce turbulence and thereby improve efficiency. The designs reduce the entrainment of ambient air by using a smooth curve design for the air deflector that reduces a steep variation in velocity across the air curtain and thereby reduces turbulence. Modeling has suggested that this may improve energy efficiency by more than ten percent.

In one alternative embodiment, the light rail 118, 218 may be incorporated as part of the air deflector. In other words, an air deflector unit is formed as described but also with features forming the light rail 118, 218.

Numerous embodiments and permutations are possible with the present disclosure. With reference to FIGS. 1-4, the following examples are given as illustrative, non-limiting embodiments:

Example 1

A refrigeration display case 100 for refrigerating and displaying perishable goods includes a base member 102 for placing proximate a support surface 111 such as a floor; a back wall 104 coupled to and substantially perpendicular to the base member 102 and extending substantially vertically (i.e., within 20 degrees of being parallel to the gravitational field) in an assembled position; and a canopy assembly 106 coupled to and substantially perpendicular to the back wall 104. The assembled position as used herein simply refers to the air deflector in its completed and installed position within the refrigeration display case. Such a position is shown in FIG. 1. The canopy assembly 106 has a front end 113, a short-dimension width 115, and a long-dimension length 117. The refrigeration display case 100 also includes an air deflector 120, 220, 320 coupled to the canopy assembly 106, 206 proximate the front end 113, 213. The base member 102, back wall 104, and canopy assembly 106, 206 form a display area 108.

The air deflector 120, 220, 320 includes a first member 222, 322 that is substantially vertical (e.g., within 20 degrees of being parallel to the gravitational field) when in an assembled position having a first end 224, 324 and a second end 226, 326 and having a first surface 328 and an opposing second surface 230, 330; a locating feature 232, 332 coupled to and extending from the second surface 230, 330 of the first member 222, 322; and a deflecting surface member 234, 334 coupled to and extending from the second surface 230, 330 of the first member 222, 322 and having a distal end 336 with a securing flange 338 for securing to a portion of the canopy assembly 106. In one illustrative embodiment, flat securing flange goes up against a portion of the canopy assembly and is attached thereto. The deflecting surface member 334 partitions the first member 322 and defines a first portion 340 and a second portion 342 of the first member 322.

The second portion 342 of the first member 322 has a distal end 344 that includes a first filter-support shelf member 346 sized and is configured to receive a first end 348 of a filter member 250, 350. The filter member fits between the first filter support shelf and a portion of the second surface of the deflecting surface member. The air deflector 120, 220, 320 also includes a flexible hinge 252, 352 formed on the second portion 342 of the first member 222, 322 to allow at least movement of a moveable portion 352 of the second portion 342. The flexible hinge in one embodiment is proximate to the location where the deflecting surface member is coupled to the first member. The flexible hinge member may be rendered flexible by a softer material, e.g., rubber, or thinning of the material so that it is more flexible than the portions around it. In one illustrative embodiment, the second end of the filter member merely rests on the shelf tab portion 355 of the second filter support shelf 354 without having a barrier on top of the filter member. In another embodiment, a small ledge could be added to the second filter support shelf on top of the filter member. The refrigeration display case 100 further includes a second filter-support shelf member 354 coupled to a portion of the canopy assembly 106, 206 and spaced from the first filter-support shelf member 346. The second filter-support shelf member 354 is sized and configured to receive a second end 356 of a filter member 350.

Example 2

The refrigeration display case of example 1, further including a filter member 350 having a rectangular cross section and removably held between the first filter-support shelf member 346 and the second filter-support shelf member 354.

Example 3

The refrigeration display case of example 1 or example 2, wherein the first member 322 has a length, $L_1$, and the locating feature 332 extends from the second surface between 5 percent and 45 percent of $L_1$ from the first end of the first member. The locating feature 332 has a length of between 5 and 20% of $L_1$.

Example 4

The refrigeration display case of any of examples 1-3, wherein the first member 322 has a length, $L_1$, and wherein the deflecting surface member 334 is coupled to the first member 322 between 10 percent and 90 percent of the length of the first member 322 from the first end 324. In a related example, the deflecting surface member 334 is coupled to the first member 322 between 50 percent and 90 percent of the length of the first member 322 from the first end 324.

Example 5

The refrigeration display case of any of examples 1-4, wherein the deflecting surface member 334 has a length $L_2$ and extends from the first member 322 substantially perpendicularly for between 40 percent and 60 percent $L_2$ before curving upwardly (more parallel to the gravity field) and then ending with the securing flange 338, which is substantially flat. The deflecting surface member 334 may have a first portion 335 and a second portion 337 with a curvature angle 339 formed therebetween. The curvature angle 339 is typically between 100 and 170 degrees. The flat portion of the securing flange 338 may comprises 5% of $L_2$ from the end 336.

Example 6

The refrigeration display case of any of examples 1-5, wherein the securing flange 338 has a first fastener aperture 362 therethrough for receiving a fastener.

Example 7

The refrigeration display case of any of examples 1-6, wherein the first member 322 has a second fastener aperture 364 therethrough proximate the first end 324 for receiving a fastener.

Example 8

The refrigeration display case of any of examples 1-7, wherein the second filter-support shelf member 354 includes a longitudinal member 354 having a shelf tab portion 355 for interfacing with one side bottom side 366 of the filter member 350 and a side support surface 358 that extends substantially perpendicularly to the shelf tab portion 355 for interfacing with a side 356 of the filter member 350, and having a canopy surface portion 370 that extends substantially parallel to the side support surface for coupling to the canopy assembly 106. The second filter-support shelf member may further include an end portion 372 that is substantially perpendicular to the canopy surface portion 370 but may be coupled in some embodiments by an angled portion 372. A terminus portion 376 may be coupled to the end portion 372.

Example 9

The refrigeration display case of any of examples 1-8, wherein the flexible hinge 352 formed on the second portion 342 of the first member 322 allows movement of the moveable portion 352 of the second portion 342 at least between 5 and 40 degrees relative to the first portion 340 of the first member 322 as suggested by angle 353.

Example 10

The refrigeration display case of any of examples 1-10, wherein the first member 322 is an integrated member formed by injection molding or extrusion and then stamping or machining to reduce or compress material in a portion to form the flexible hinge 352.

Example 11

The refrigeration display case of any of examples 1-10, wherein the deflector surface member 334 has a first side 341 and a second side 343, and wherein in the assembled positioned, the deflector surface member 334) is configured to have air 357 delivered from the back wall 104 impact the second side 343 and be directed to a top surface 351 of the filter member 350.

Example 12

An air deflector 120, 220, 320 for use in a refrigerated display case 100 includes a first member 322 that is substantially vertical in an assembled position having a first end 324 and a second end 326 and having a first surface 328 and an opposing second surface 330; a locating feature 232, 332 extending from the second surface 330 of the first member 222, 322. The air deflector 120, 220, 320 further includes a deflecting surface member 234, 334 extending from the second surface 330 of the first member 322 and having a distal end 336 with a securing flange 338 for securing to a portion of the canopy assembly 106, 206. The deflecting surface member 334 partitions the first member 322 and defines a first portion 340 and a second portion 342 of the first member 322. The second portion 342 of the first member 322 has a distal end 344 that includes a first filter-support shelf member 346 sized and configured to receive a first end 348 of a filter member 350, and includes a flexible hinge 352 formed on the second portion 342 of the first member 322 to allow at least movement of a moveable portion 352 of the second portion 342.

Example 13

The air deflector of example 12, wherein the first member 322 has a length, $L_1$, and the locating feature 332 extends from the second surface between 5 percent and 45 percent of $L_1$ from the first end of the first member. The locating feature 332 has a length of between 5 and 20% of $L_1$.

Example 14

The air deflector of example 12 or example 13, wherein the first member 322 has a length, $L_1$, and wherein the deflecting surface member 334 is coupled to the first member 322 between 5 percent and 65 percent of the length of the first member 322 from the first end 324.

Example 15

The air deflector of any of examples 12-14, wherein the deflecting surface member 334 has a length $L_2$ and extends from the first member 322 substantially perpendicularly for between 40 percent and 60 percent $L_2$ before curving upwardly and then ending with the securing flange 338, which is substantially flat.

Example 16

The air deflector of example 12, wherein the deflecting surface member 334 has a length $L_2$ and extends from the first member 322 substantially perpendicularly for between 40 percent and 60 percent $L_2$ before curving upwardly and then ending with the securing flange 338, which is substantially flat; wherein the deflecting surface member 334 includes a first portion 335 and a second portion 337 with a curvature angle 339 formed therebetween, and wherein the curvature angle 339 is between 100 and 170 degrees.

Example 17

The air deflector of any of examples 12-16, wherein the living hinge flexes between 5 and 45 degrees.

Example 18

The air deflector of any of examples 12-17, wherein the first member 322 is an integrated member formed by injection molding or extrusion and then stamping or machining to reduce or compress material in a portion to form the flexible hinge 352.

Example 19

The air deflector of any of examples 12-18, wherein the securing flange 338 has a first fastener aperture 362 therethrough for receiving a fastener.

Example 20

The air deflector of any of examples 12-19, wherein the first member 322 has a second fastener aperture 364 therethrough proximate the first end 324 for receiving a fastener.

In the detailed description of the preferred embodiments herein, reference is made to the accompanying drawings that form a part hereof, and in which is shown, by way of illustration, specific embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may have omitted certain information known to those skilled in the art. The detailed description is, therefore, not to be taken in a limiting sense, and the scope of the present invention is defined only by the claims. Unless otherwise indicated, as used throughout this document, "or" does not require mutual exclusivity.

Although the present invention and its advantages have been disclosed in the context of certain illustrative, non-limiting embodiments, it should be understood that various changes, substitutions, permutations, and alterations can be made without departing from the scope of the invention as defined by the claims. It will be appreciated that any feature that is described in a connection to any one embodiment may also be applicable to any other embodiment.

What is claimed:

1. A refrigeration display case for refrigerating and displaying perishable goods, the refrigeration display case comprising:

a base member for placing proximate a support surface;

a back wall coupled to and substantially perpendicular to the base member and extending substantially vertically in an assembled position;

a canopy assembly coupled to and substantially perpendicular to the back wall, the canopy assembly having a front end, and having a short-dimension width and a long-dimension length;

an air deflector coupled to the canopy assembly proximate the front end;

wherein the base member, back wall, and canopy assembly form a display area;

wherein the air deflector comprises:

a first member that is substantially vertical in the assembled position having a first end and a second end and having a first surface and an opposing second surface, a locating feature extending from the second surface of the first member, a deflecting surface member extending from the second surface of the first member and having a distal end with a securing flange for securing to a portion of the canopy assembly, wherein the deflecting surface member partitions the first member and defines a first portion and a second portion of the first member, wherein the second portion of the first member has a distal end that comprises a first filter-support shelf member sized and configured to receive a first end of a filter member, and a flexible hinge formed on the second portion of the first member to allow at least movement of a moveable portion of the second portion; and a second filter-support shelf member coupled to a portion of the canopy assembly and spaced from the first filter-support shelf member, wherein the second filter-support shelf member is sized and configured to receive a second end of a filter member.

2. The refrigeration display case of claim 1, further comprising a filter member having a rectangular cross section and removably held between the first filter-support shelf member and the second filter-support shelf member.

3. The refrigeration display case of claim 1, wherein the first member has a length, $L_1$, and the locating feature extends from a location on the second surface that is between 5 percent and 45 percent of $L_1$ from the first end of the first member.

4. The refrigeration display case of claim 1, wherein the first member has a length, $L_1$, and wherein the deflecting surface member is coupled to the first member between 50 percent and 90 percent of the length of the first member from the first end.

5. The refrigeration display case of claim 1, wherein the deflecting surface member has a length $L_2$ and extends from the first member substantially perpendicularly for between 40 percent and 60 percent $L_2$ before curving and then ending with the securing flange that is substantially flat.

6. The refrigeration display case of claim 5, wherein the securing flange has a first fastener aperture therethrough for receiving a fastener.

7. The refrigeration display case of claim 1, wherein the first member has a second fastener aperture therethrough proximate the first end for receiving a fastener.

8. The refrigeration display case of claim 1, wherein the second filter-support shelf member comprises a longitudinal member having a shelf tab portion for interfacing with a bottom side of a filter member and a side support surface that extends substantially perpendicularly to the shelf tab portion for interfacing with a side of the filter member, and having a canopy surface portion that extends substantially parallel to the side support surface for coupling to the canopy assembly.

9. The refrigeration display case of claim 1, wherein the flexible hinge formed on the second portion of the first member is configured to allow movement of the moveable portion of the second portion at least between 5 and 40 degrees relative to first portion of the first member.

10. The refrigeration display case of claim 1, wherein the first member is an integrated member formed by injection molding or extrusion and then stamping or machining to reduce or compress material in a portion to form the flexible hinge.

11. The refrigeration display case of claim 1, wherein the deflector surface member has a first side and a second side, and wherein in the assembled positioned, the deflector surface member is configured to have air delivered from the back wall impact the second side and be directed to a top surface of the filter member.

12. An air deflector for use in a refrigerated display case at a location proximate a first end of a canopy assembly, the air deflector comprising:

a first member that is substantially vertical in an assembled position having a first end and a second end and having a first surface and an opposing second surface, a locating feature extending from the second surface of the first member, a deflecting surface member extending from the second surface of the first member and having a distal end with a securing flange for securing to a portion of the canopy assembly, wherein the deflecting surface member partitions the first member and defines a first portion and a second portion of the first member, wherein the second portion of the first member has a distal end that comprises a first filter-support shelf member sized and configured to receive a first end of a filter member, and a flexible hinge formed on the second portion of the first member to allow at least movement of a moveable portion of the second portion.

13. The air deflector of claim 12, wherein the first member has a length, $L_1$, and the locating feature extends from the second surface between 5 percent and 45 percent of $L_1$ from the first end of the first member.

14. The air deflector of claim 12, wherein the first member has a length, $L_1$, and wherein the deflecting surface member is coupled to the first member between 5 percent and 65 percent of the length of the first member from the first end.

15. The air deflector of claim 12, wherein the deflecting surface member has a length $L_2$ and extends from the first member substantially perpendicularly for between 40 percent and 60 percent $L_2$ before curving upwardly for an orientation in an assembled position and then ending with the securing flange that is substantially flat.

16. The air deflector of claim 12, wherein the deflecting surface member has a length $L_2$ and extends from the first member substantially perpendicularly for between 40 percent and 60 percent $L_2$ before curving upwardly for an orientation in an assembled position and then ending with the securing flange that is substantially flat; wherein the deflecting surface member comprises a first portion and a second portion with a curvature angle formed therebetween, and wherein the curvature angle is between 100 and 170 degrees.

17. The air deflector of claim 12, wherein the flexible hinge flexes between 5 and 45 degrees.

18. The air deflector of claim 12, wherein the first member is an integrated member formed by injection molding or extrusion and then stamped or machined to reduce or compress material in a portion to form the flexible hinge.

19. The air deflector of claim 12, wherein the securing flange has a first fastener aperture therethrough for receiving a fastener.

20. The air deflector of claim 12, wherein the first member has a second fastener aperture therethrough proximate the first end for receiving a fastener.

* * * * *